United States Patent [19]

Hayashi et al.

[11] 4,221,203

[45] Sep. 9, 1980

[54] CROSS-FLOW TYPE INTERNAL COMBUSTION ENGINE WITH A SMALL SIZED EXHAUST GAS RECIRCULATING SYSTEM

[75] Inventors: Yoshimasa Hayashi, Yokohama; Akihiro Ohnishi, Kitamoto; Makio Waku, Urawa; Hideo Kamino, Fuchu, all of Japan

[73] Assignee: Nissan Motor Company, Limited, Yokohama, Japan

[21] Appl. No.: 916,057

[22] Filed: Jun. 16, 1978

Related U.S. Application Data

[63] Continuation of Ser. No. 691,025, May 28, 1976, abandoned.

[30] Foreign Application Priority Data

Jun. 24, 1975 [JP] Japan ..... 50-88313

[51] Int. Cl.[2] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 2,257,631 | 9/1941 | Wahlberg | 60/323 |
| 3,937,194 | 2/1976 | Tamaki et al. | 123/119 A |
| 4,056,083 | 4/1976 | Wakita | 123/119 A |

FOREIGN PATENT DOCUMENTS

| | | | |
|---|---|---|---|
| 2345556 | 9/1973 | Fed. Rep. of Germany | 123/148 DS |

*Primary Examiner*—Wendell E. Burns

*Attorney, Agent, or Firm*—Robert E. Burns; Emmanuel J. Lobato; Bruce L. Adams

[57] ABSTRACT

A cylinder head of a cross-flow type internal combustion engine is formed with a through hole or a groove which is associated with an exhaust gas recirculating system to simplify the exhaust gas recirculating system and simultaneously to make it small.

4 Claims, 5 Drawing Figures

CROSS-FLOW TYPE INTERNAL COMBUSTION ENGINE WITH A SMALL SIZED EXHAUST GAS RECIRCULATING SYSTEM

This is a continuation of application Ser. No. 691,025, filed May 28, 1976.

BACKGROUND OF THE INVENTION

The present invention relates in general to an internal combustion engine system for a motor vehicle, and more particularly to a cross-flow type internal combustion engine system having an exhaust gas recirculating system operable of feeding a portion of the exhaust gases of the engine into the intake of the engine.

As well known in the art, the nitrogen oxides ($NO_x$) belong to a group of components which is greatly difficult to avoid from forming in the exhaust gases issued from the internal combustion engine. One of the ways for reducing the formation of such harmful nitrogen oxides ($NO_x$) in the exhaust gases is a so called "exhaust gas recirculation" in which a portion of the exhaust gases is fed, during the engine operation, into the engine via an intake manifold. With this procedure, the combustion temperature of the air-fuel mixture in each of the combustion chambers are considerably lowered to prevent the creation of the nitrogen oxides ($NO_x$).

A conventional exhaust gas recirculating system generally comprises a conduit tube which connects the interior of the intake manifold with that of the exhaust manifold.

However, in a case that the conventional system is equipped to a cross-flow type internal combustion engine, the conduit must be so arranged over the engine proper thereby causing need of a considerably long construction of the conduit tube. Thus, the whole structure of the engine system of this type is large inevitably thereby narrowing the space of the engine room of the motor vehicle. The assemblage of such a conduit tube to the engine proper due to the long construction of it. Furthermore, for firmly supporting the long conduit tube onto the engine proper, a relatively big and expensive support means is required.

SUMMARY OF THE INVENTION

Therefore, the present invention contemplates provision of an internal combustion engine system which can eliminate the above-mentioned drawbacks of the prior art engine system.

It is an object of the present invention to provide a cross-flow type internal combustion engine system which is equipped with an improved exhaust gas recirculating system constructed relatively small.

It is another object of the present invention to provide an improved exhaust gas recirculating system which is so constructed to allow the recirculating exhaust gases to pass through a passage formed in a cylinder head of the engine proper.

It is another object of the present invention to provide an improved exhaust gas recirculating system which comprises a conduit tube having a portion received in a groove formed in the engine proper.

It is another object of the present invention to provide an improved exhaust gas recirculating system which has a conduit tube having a portion integral with a part of an intake manifold of the engine.

It is still another object of the present invention to provide a cross-flow type internal combustion engine system which is relatively compact in construction thereby facilitating the mounting thereof to the engine room of the motor vehicle.

BRIEF DESCRIPTION OF THE DRAWINGS

Other objects and advantages of the present invention will become more clear from the following description when taken in conjunction with the accompanying drawings, in which.

DESCRIPTION OF THE PREFERRED EMBODIMENTS

Figure 1:
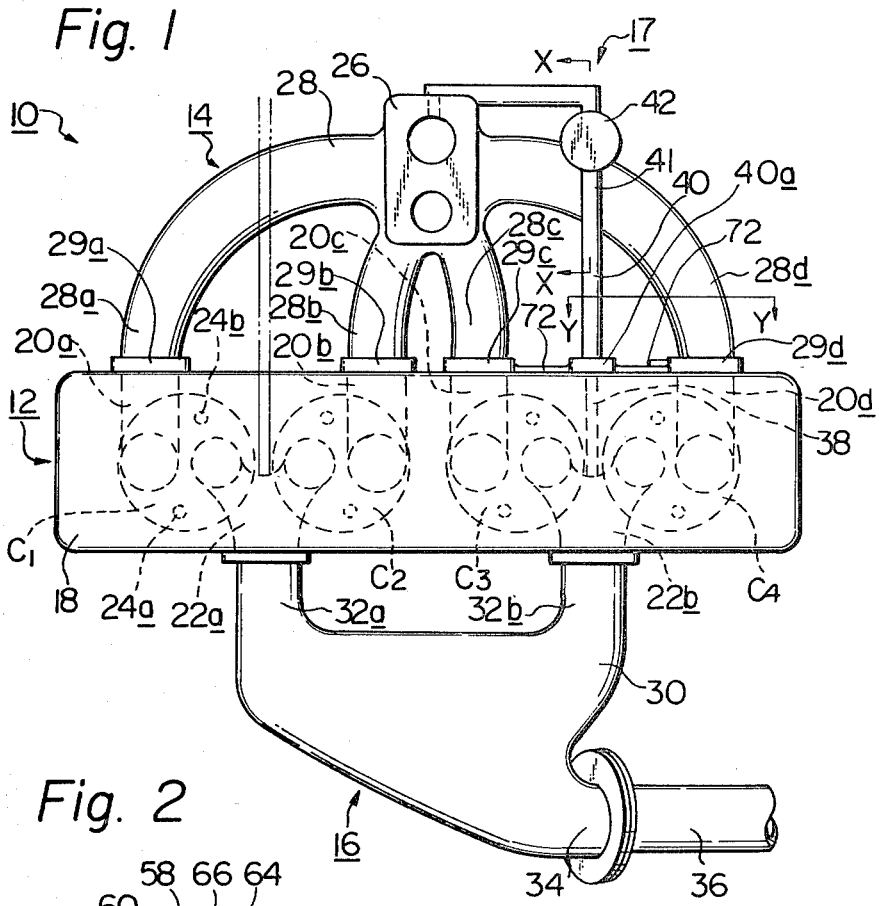
FIG. 1 is a sketch of a cross-flow type internal combustion engine system of a first preferred embodiment according to the present invention.

Referring now to FIG. 1 of the drawings, there is schematically illustrated a cross-flow type internal combustion engine system 10 of a first preferred embodiment of the invention, which generally comprises an engine proper section 12, an intake section 14, an exhaust section 16, and an exhaust gas recirculating section 17.

The engine proper section 12 is illustrated to have four combustion chambers $C_1$ to $C_4$ each of which consists of an upper portion of a cylinder bore formed in a cylinder block (not shown) and recess formed in a cylinder head 18. The cylinder head 18 is formed at one side thereof with four intake ports 20*a* to 20*d* which are respectively communicable with the four combustion chambers $C_1$ to $C_4$ through respective intake valves (not shown). Furthermore, the cylinder head 18 is formed at the other side portion thereof with two siamesed exhaust ports 22*a* and 22*b* in which the port 22*a* communicates with both of the combustion chambers $C_1$ and $C_2$ through respective exhaust valves (not shown), while the port 22*b* communicates with both of the chambers $C_3$ and $C_4$ through respective exhaust valves (not shown). As shown, the intake ports 20*a* to 20*d* and the siamesed exhaust ports 22*a* and 22*b* ae extended in the opposite directions to make the cylinder head 18 of a cross-flow type. Projected into each of the combustion chambers $C_1$ to $C_4$ are a pair of spark plugs 24*a* and 24*b*, though only the numerals on the chamber $C_1$ are carried, which are spaced apart from each other and positioned symmetrically in each combustion chamber with respect to the center axis of the each combustion chamber. Of course, it is also possible to employ only one spark plug in each of the chambers $C_1$ to $C_4$ instead of the two and more spark plugs.

The intake section 14 generally comprises an air-fuel mixture supply means such as a carburetor 26, and an intake manifold 28 having four tubes 28*a* to 28*d* united at the upstream portions thereof to the carburetor 26 and respectively connected at the downstream portions thereof to the intake ports 20*a* to 20*d* through respective flanges 29*a* to 29*d*.

The exhaust section 16 comprises a thermal reactor 30 having two inlet tubes 32*a* and 32*b* respectively connected to the siamesed exhaust ports 22*a* and 22*b*, and an outlet tube 34 conneted to an exhaust tube 36.

Figure 2:
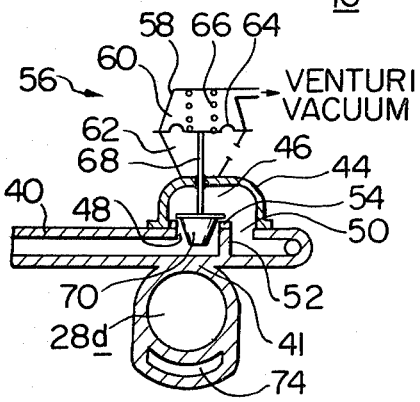
FIG. 2 is a fragmentary sectional view taken along the line X—X of FIG. 1.

The exhaust gas recirculating section 17 of this embodiment has a very characteristic construction, which comprises a through hole 38 formed in the cylinder head 18, a conduit tube 40 connecting the through hole 38 with an air-fuel mixture passage of the carburetor 26, and a gas flow controller 42 disposed in the conduit tube 40. The through hole 38 is so arranged in the cylinder head 18 to extend from the siamesed exhaust port 22*b* communicable with the two combustion chambers $C_3$ and $C_4$ to the intake section side of the cylinder head 18. Connected at its one end to the through hole 38 through a flange 40*a* from the intake section side of the cylinder head 18 is the conduit tube 40 which is open at the other end thereof into the air-fuel mixture passage defined in the carburetor 26. As well shown in FIG. 2, the conduit tube 40 has at a generally middle portion thereof a portion 41 integral with the tube 28*d* of the intake manifold 28. The intake manifold 28 and the conduit tube 40 may be formed simultaneously in a single casting process or may be connected by welding. The gas flow controller 42, shown well in FIG. 2, functions to control the flow rate of the exhaust gases passing through the conduit tube 40 into the air-fuel mixture passage of the carburetor 26 in response to the magnitude of venturi vacuum created in the carburetor 26, and which comprises a case member 44 mounted on a portion of the conduit tube 40 and having therein a chamber 46 which is communicable with the siamesed exhaust port 22*b* in the cylinder head 18 and the air-fuel mixture passage of the carburetor 26 through respective openings 48 and 50 which are formed in the portion of the conduit tube 40. A partition wall 52 is provided in the conduit tube 40 at a position between the openings 48 and 50 for allowing the exhaust gases from the siamesed exhaust port 22*b* to pass through the chamber 46 of the case member 44. Mounted on the opening 48 is a valve seat 54. A vacuum motor 56 is connected at the lower end thereof to the case member 44, which comprises a casing 58 having therein first and second chambers 60 and 62 which are separated by a diaphragm member 64. The first and second chambers 60 and 62 respectively communicate with a venturi portion (not shown) of the carburetor 26 and the atmosphere through respective openings (no numerals), as shown. Within the first chamber 60 is disposed a compression spring 66 which urges the diaphragm member 64 toward the second chamber 62. A valve stem 68 having at its one end a tapered valve head 70 is connected, after passing through the chamber 46 of the case member 44 and the second chamber 62 of the casing 58, at its other end to the diaphragm member 64 in such a manner that the valve head 70 can be insertable into the opening 48 as the diaphragm member 64 moves downwardly of the drawing. Thus, it is to be noted that the degree of a clearance (no numeral) defined between the valve head 70 and the opening 48 is proportionally varied in accordance with the upward and downward movements of the valve head 70. With the provision of the gas flow controller 42, the amount of exhaust gases to be fed into the air-fuel mixture passage of the carburetor 26 from the siamesed exhaust port 22*b* is so controlled to increase proportionally with the increase of the venturi vacuum.

If desired, another exhaust gas recirculating means may be employed in this engine system in such a way as indicated by phantom lines in FIG. 1.

Figure 3:
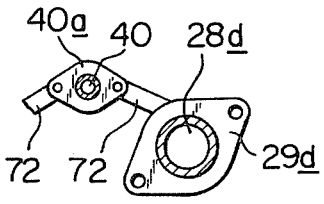
FIG. 3 is a fragmentary sectional view taken along the section line Y—Y of FIG. 1.

FIG. 3 shows an example to more firmly support the conduit tube 40 onto the engine system 10, in which a a pair of supporting rods 72 each having both ends firmly connected to the flanges 29*d* and 40*a*, (29*c* and 40*a*) are employed.

Referring back to FIG. 2 of the drawings, there is shown a heat transfer chamber 74 formed in a lower portion of the tube 28*d* of the intake manifold 28. The chamber 74 extends along the whole length of the tube 28*d* from its upstream portion (near the carburetor 26) to its leading end equipped with the flange 29*d*. The other tubes 28*a* to 28*c* of the intake manifold 28 have respective heat transfer chambers which are similar to the chamber 74 of the tube 28*d*. These heat transfer chambers 74 are in communication with water jackets (not shown) formed in the cylinder head 18 so that the hot water from the water jackets preheats the air-fuel mixture being passed through the tubes 28*a* to 28*d* of the intake manifold 28. In order to achieve an effective heat exchanging between the hot water from the water jackets and the air-fuel mixture in each tubes 28*a* to 28*d*, it is preferable to arrange each of the heat transfer chambers 74 so as to receive the hot water, just coming out from the water jackets of the cylinder head 18, through an inlet opening (not shown) formed in the vicinity of the corresponding flange 29*a* to 29*d* and then to drain the water, being passed through the heat transfer chamber 74, through an outlet opening (not shown) formed in the united portion of the tubes 28*a* to 28*d* of the intake manifold 28.

Figure 4:
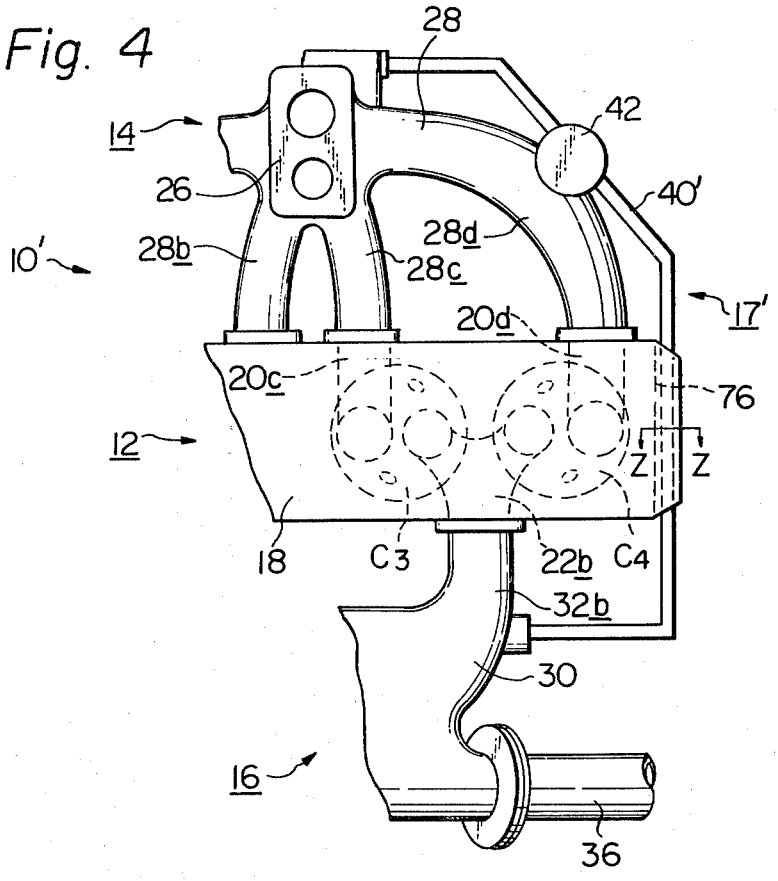
Fig. 4 is a sketch, though in a part, of a cross-flow type internal combustion engine system of a second preferred embodiment according to the present invention.

Now, referring to FIG. 4, there is shown the second embodiment of the engine system 10' according to the present invention. In order to simplify the explanation of this embodiment, detailed description on the parts designated by the same reference numerals as in the parts of FIG. 1 will not be made hereinlater.

Figure 5:
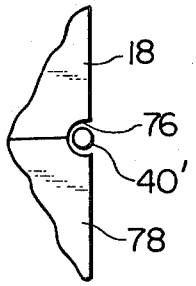
FIG. 5 is a fragmentary sectional view taken along the line Z– Z of FIG. 4.

In this embodiment, there is also provided a characteristic construction on the exhaust gas recirculating section 17'. The section 17' comprises a groove 76 which is formed in and positioned at contacting edge surfaces of the cylinder head 18 and the cylinder block 78, as well shown in FIG. 5. Of course, the groove 76 may be provided in the cylinder head 18 per se or in the cylinder block per se instead of in their contacting edge surfaces.

Longitudinally disposed in the groove 76 is a portion of the conduit tube 40' which is fluidly connected at its one end to the inlet tube 32*b* of the thermal reactor 30 and at its other end to the air-fuel mixture passage defined in the carburetor 26. In this instance, it is preferable to form the groove so as to have a depth slightly larger than the diameter of the portion of the conduit tube. In the same manner as the first embodiment, the conduit tube 40' has a portion integral with the tube 28*d* of the intake manifold 28. Furthermore, the gas flow controller 42 is also provided in the conduit tube 40' to control the flow rate of the exhaust gases being passed through the conduit tube 40' into the carburetor 26 according to the magnitude of the venturi vacuum.

With the above-stated constructions of the first and second embodiments of the engine system according to the invention, the following merits and advantages are obtained:

(1) By the provision of the through hole 38 (first embodiment) or the groove 76 (second embodiment), the exhaust gas recirculating section 17 can be made relatively compact in size, so that when the engine system equipped with this arrangement of the exhaust gas recirculating section 17 is mounted in the engine room of the vehicle, it will not narrow the space of the engine room excessively.

(2) Since the conduit tube 40 is unitedly connected at a portion thereof to the intake manifold 28, any other fastening means such as a bracket is unnecessary. Thus, the productively of the engine system with these arrangements of the exhaust gas recirculating section is considerably improved.

It is now to be noted that when each of the combustion chambers is equipped with two or more spark plugs, the flame propagation process in the combustion chamber can be completed in a short period of time to provide the engine with a remarkably stable operation. Thus, even if a large amount of exhaust gases, for example about 12 to 25% of the intake air by volume, is fed into the combustion chambers via the exhaust gas recirculating section or means, the stable operation of the engine is hardly affected by the recirculated exhaust gases.

Although, in the previous description, only two embodiments have been shown and described, the invention is not limited to the disclosed embodiments but is defined by the following Claims.

What is claimed is:

1. A system comprising:

an inline reciprocating internal combustion engine having a cylinder block and a cross flow type cylinder head disposed on top the cylinder block to define therebetween four aligned combustion chambers, said cylinder head having on one side and the other side portions with four intake ports and two siamesed exhaust ports, each of said two siamesed exhaust ports being disposed to unite two adjacent exhaust ports which respectively lead from two adjacent combustion chambers of said four combustion chambers, each of said combustion chambers having therein two spaced spark plugs;

an intake manifold having four tubes united at upstream portions thereof respectively fluidly connected at the downstream portions thereof to said four intake ports of said cylinder head;

an air-fuel mixture supply means positioned upstream of said intake manifold for supplying an air-fuel mixture into said intake manifold;

a thermal reactor having two inlet tubes and an outlet tube, said two inlet tubes being respectively connected to said two siamesed exhaust ports so that exhaust gases from said combustion chambers are forced to pass through said thermal reactor for after-combustion thereof before being discharged into the atmosphere through said outlet tube; and exhaust gas recirculating means for recirculating a portion of the exhaust gases from the combustion chambers back into said combustion chambers through said intake manifold, said exhaust gas recirculating means comprising a through hole formed in said cylinder head to extend from one of said siamesed exhaust ports to the one side portion of said cylinder head, a conduit tube having one end open into an air-fuel mixture passage defined in said air-fuel mixture supply means and the other end fluidly connected to said through hole, and a gas flow controller disposed in said conduit tube to control the flow rate of the exhaust gases passing through the conduit tube into the air-fuel mixture passage in response to the degree of venturi vacuum created in said air-fuel mixture passage of said air-fuel mixture supply means.

2. A system as claimed in claim 1 in which said conduit tube of said exhaust gas recirculating means has a portion integral with one of said tubes of said intake manifold.

3. A system as claimed in claim 2, in which said gas flow controller is located in the vicinity of said portion of said conduit tube.

4. A system as claimed in claim 1, further comprising a supporting rod having ends respectively connected to said conduit tube and said one of said tubes of said intake manifold at a position in the vicinity of said cylinder head for tight support of said conduit tube.

* * * * *